US008443735B2

(12) United States Patent
Kumar et al.

(10) Patent No.: US 8,443,735 B2
(45) Date of Patent: May 21, 2013

(54) VEHICLE AND TRUCK ASSEMBLY

(75) Inventors: Ajith Kuttannair Kumar, Erie, PA (US); Bret Worden, Union City, PA (US); Michael Marley, Erie, PA (US); Amit Iyer, Lawrence Park, PA (US); Adrian Gorski, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 706 days.

(21) Appl. No.: 12/353,625

(22) Filed: Jan. 14, 2009

(65) Prior Publication Data

US 2010/0175581 A1 Jul. 15, 2010

(51) Int. Cl.
*B61D 1/00* (2006.01)

(52) U.S. Cl.
USPC ..... 105/157.1; 105/168

(58) Field of Classification Search ..... 105/218.1, 105/224.05, 224.06, 224.1, 195, 196, 188, 105/182.1, 172, 166, 157.1, 168
See application file for complete search history.

(56) References Cited

U.S. PATENT DOCUMENTS

| | | | | | |
|---|---|---|---|---|---|
| 2,393,722 | A | * | 1/1946 | Travilla, Jr. | 105/195 |
| 2,660,960 | A | * | 12/1953 | Borgeaud et al. | 105/188 |
| 3,719,153 | A | * | 3/1973 | Schumacher | 105/182.1 |
| 3,911,830 | A | * | 10/1975 | Adams | 105/164 |
| 4,170,179 | A | * | 10/1979 | Vogel | 105/168 |
| 4,679,506 | A | * | 7/1987 | Goding et al. | 105/136 |
| 4,679,507 | A | * | 7/1987 | Rassaian | 105/136 |
| 4,735,149 | A | * | 4/1988 | Scheffel et al. | 105/218.1 |
| 4,986,192 | A | * | 1/1991 | Wiebe | 105/198.4 |
| 5,131,332 | A | * | 7/1992 | Smith | 105/224.05 |
| 5,263,420 | A | * | 11/1993 | Schwendt et al. | 105/166 |
| 5,575,221 | A | * | 11/1996 | Biegel et al. | 105/226 |
| 5,588,367 | A | * | 12/1996 | Scheffel | 105/168 |
| 5,613,444 | A | * | 3/1997 | Ahmadian et al. | 105/166 |
| 5,746,134 | A | * | 5/1998 | Scheffel | 105/168 |
| 5,746,135 | A | * | 5/1998 | Ahmadian et al. | 105/196 |
| 6,745,700 | B2 | * | 6/2004 | Ma et al. | 105/166 |
| 6,871,598 | B2 | * | 3/2005 | Schaller et al. | 105/168 |
| 7,631,603 | B2 | * | 12/2009 | Forbes et al. | 105/157.1 |
| 2009/0031915 | A1 | * | 2/2009 | Kumar et al. | 105/34.1 |
| 2009/0031916 | A1 | * | 2/2009 | Kumar et al. | 105/34.1 |
| 2009/0031917 | A1 | * | 2/2009 | Kumar et al. | 105/35 |
| 2009/0095196 | A1 | * | 4/2009 | Kumar et al. | 105/96 |
| 2009/0095197 | A1 | * | 4/2009 | Kumar et al. | 105/96 |
| 2009/0099714 | A1 | * | 4/2009 | Kumar et al. | 701/19 |
| 2010/0175580 | A1 | * | 7/2010 | Gorski et al. | 105/157.1 |
| 2010/0175581 | A1 | * | 7/2010 | Kumar et al. | 105/157.1 |

FOREIGN PATENT DOCUMENTS

| | | | |
|---|---|---|---|
| EP | 773152 | A1 * | 5/1997 |
| JP | 61024606 | A * | 2/1986 |

* cited by examiner

*Primary Examiner* — Jason C Smith
(74) *Attorney, Agent, or Firm* — Shawn McClintic; Alleman Hall McCoy Russell & Tuttle LLP

(57) ABSTRACT

Truck assemblies, systems and methods are provided for transferring weight supported by various wheels, and axles. An example truck assembly may include a truck frame element, and a carrier coupled with the truck frame element. A bias may be configured to bias the carrier away from the truck frame element. An actuatable linkage arrangement may include a compliant linkage coupled with the carrier. The compliant linkage may pull the carrier against the bias in a first direction.

19 Claims, 8 Drawing Sheets

VEHICLE AND TRUCK ASSEMBLY

BACKGROUND

1. Technical Field

Embodiments of the invention may relate to a truck assembly, a vehicle having the truck assembly, and/or a method of operating the truck assembly, for example.

2. Discussion of Art

The cost of manufacturing vehicles, and the cost of maintaining an inventory of production parts, may increase in accordance with the level of customization of individual vehicle models. The part inventory may increase because of the complexity of the product mix produced in a production environment. Some vehicles may include a front truck and a rear truck with two or more axles on each truck. Each axle may have a motor. In a manufacturing instance where the power required for one vehicle is less than another, the lower powered vehicle may need to be produced with a number of motors of lesser power equal to the number of axles. Distributing the motors among all the axles may improve the wheel traction during use. Maintaining a production environment that includes relatively more component options, such as using all lower power motors in a first model in place of all higher power motors, used in a second model, may be undesirable. The inventors herein have recognized that it may be useful to have a truck assembly that differs from those truck assemblies that are currently available.

BRIEF DESCRIPTION

One example embodiment includes a vehicle truck assembly comprising a carrier coupled with a truck frame element, the carrier carrying an axle, a bias structure configured to bias the carrier away from the truck frame element, and an actuatable linkage arrangement including a compliant linkage coupled with the carrier, the compliant linkage configured to pull the carrier against the bias in a first direction toward the truck frame element, and the compliant linkage being unable to push against the carrier in a second direction that is about opposite the first direction.

Another example embodiment includes a vehicle comprising a truck arrangement having a driven axle and an un-driven axle, the un-driven axle exerting a force to support the truck arrangement, the force being selectively reducible by pulling a compliant linkage against a bias, and the force being selectively increasable by the bias upon releasing the compliant linkage.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF FIGURES

FIG. 1 shows a vehicle comprising an embodiment of the invention.

FIGS. 2*a*-2*b* are graphs illustrating example relationships of force exerted by a spring and deflection of the spring.

FIG. 3*a* illustrates a right side sectional view, and FIG. 3*b* illustrates a left side sectional view of an example truck.

FIG. 4*a* is a perspective view from a first side, and FIG. 4*b* is a perspective view from an opposite second side illustrating an example carrier, and spring system.

Figure 8A:
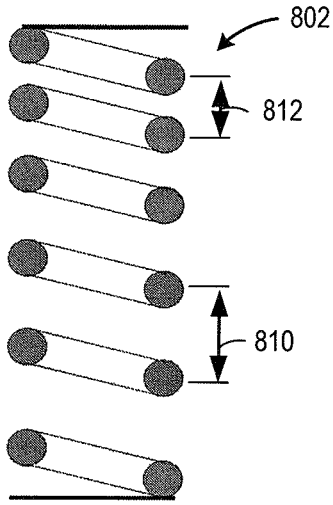
Figure 8B:
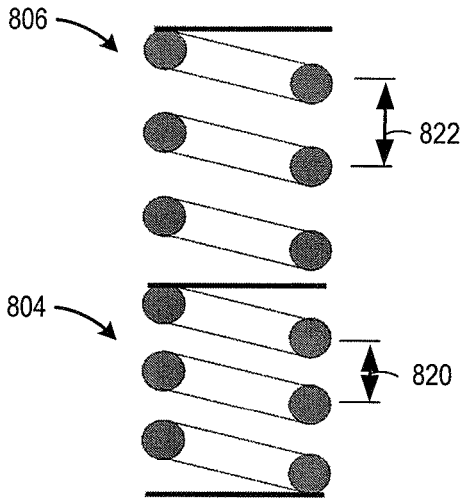

FIGS. 8*a* and 8*b* show example spring configurations.

DETAILED DESCRIPTION

Embodiments of the invention may relate to a truck (or bogie) assembly, a vehicle having the truck assembly, and a method of operating the truck assembly. Vehicles, truck assemblies, systems and/or methods are provided for transferring weight among wheels and/or axles supporting the rail vehicle. As an example, the vehicle may be a locomotive or rail vehicle that can be positioned on a rail.

In one embodiment, an example method includes operating a vehicle having a suspension. The method may include operating the suspension in a first mode with a first effective suspension spring rate; and operating the suspension in a second mode with a second, different, effective suspension spring rate.

The suspension may comprise one or more springs, where the one or more springs together have an effective spring rate that varies with displacement of the suspension. In some conditions the rail vehicle selectively, and in some cases dynamically, increases normal force on the rail (and thus tractive force) by distributing a supported load from un-powered to powered axles coupled to the suspension when traction is desired, and likewise maintaining the supported load more evenly distributed among the powered and un-powered axles when less traction is desired. In this way, it may be possible to operate the suspension with a higher effective spring rate when distributing the load from un-powered to powered axles to reduce over-compression of the suspension during increased traction. Likewise, it may be possible to operate the suspension with a lower effective spring rate with more even loading of the axles to provide a smoother ride and less frame stresses at higher speeds, with reduced actuator forces and reduced actuator displacement.

In one embodiment, a truck includes a truck frame element; a first, powered, axle; a first axle carrier coupled to the first axle; a first spring system coupling the first axle carrier to the truck frame element; a second, un-powered axle; a second axle carrier coupled to the second axle; and a second spring system coupling the second axle carrier to the truck frame element. The first spring system can have a somewhat or substantially non-linear effective spring rate, and the second spring system has rather linear effective spring rate. In another alternative, an effective spring rate of a first axle of a truck may be substantially similar to an effective spring rate of a second axle of a truck for axle loads up to a threshold axle load. Then, for loads higher than the threshold, the effective spring rates of the first and second axles may differ. Further still, first and second axles of a truck may be configured to provide unequal static loads under static conditions so as to balance the load under dynamic conditions when a weight shift may occur due to tractive effort.

Again, such a configuration may enable relatively improved operation in some circumstances during increased tractive effort when dynamically distributing load from the un-powered to the powered axle. This may enable relatively improved operation in some circumstances at higher speeds when both the powered and un-powered axle operate under substantially even loads. And, in some circumstances, this may provide a relatively smoother ride.

An example truck assembly may include a truck frame element, and a carrier coupled with the truck frame element. A bias structure may be configured to bias the carrier away from the truck frame element. An actuatable linkage arrangement may include a compliant linkage coupled with the carrier. The compliant linkage may be configured to pull the carrier against the bias in a first direction. The compliant linkage may be unable, or almost unable, to effectively push against the carrier in a second direction opposite the first direction. The carrier may carry a powered axle.

By enabling the compliant linkage to pull the carrier against the bias in the first direction, it is possible to selectively control increased compression of the carrier toward the truck frame element to effect a dynamic re-distribution of the load to other axles of the truck assembly. Further, because the compliant linkage may be unable to effectively or substantially push against the carrier in the second direction, a tendency for the compliant linkage to counteract natural suspension action of the bias during travel is reduced. In this way, stresses on the frame element may be reduced.

Still other example embodiments may enable use of motors of similar power ratings for both high power locomotives and for low power locomotives. Such use may enable a variable number of motors to power a corresponding number of axles. An example locomotive for riding on rails may include a truck arrangement having a driven axle and an un-driven axle. The un-driven axle may exert a normal force on the rails. The force may be selectively reduced by pulling a compliant linkage against a bias. In addition, the force may be increased by the bias upon releasing the compliant linkage. In this way, the compliant linkage may only be able to pull the un-driven axle up in a direction away from the track to reduce the force, but may be substantially unable to push the un-driven axle down into increased engagement with the track.

Also, while the example embodiment described herein include a truck having a powered and un-powered axle, where the un-powered axle can be compressed (pulled vertically) via an actuator to effect a dynamic weight shift, in an alternative embodiment the powered axle may be configured with actuators which pushes down on the powered axle against a bias relieving the load on the unpowered axle. Further still, both powered and un-powered axles may be actuated.

Figure 1:
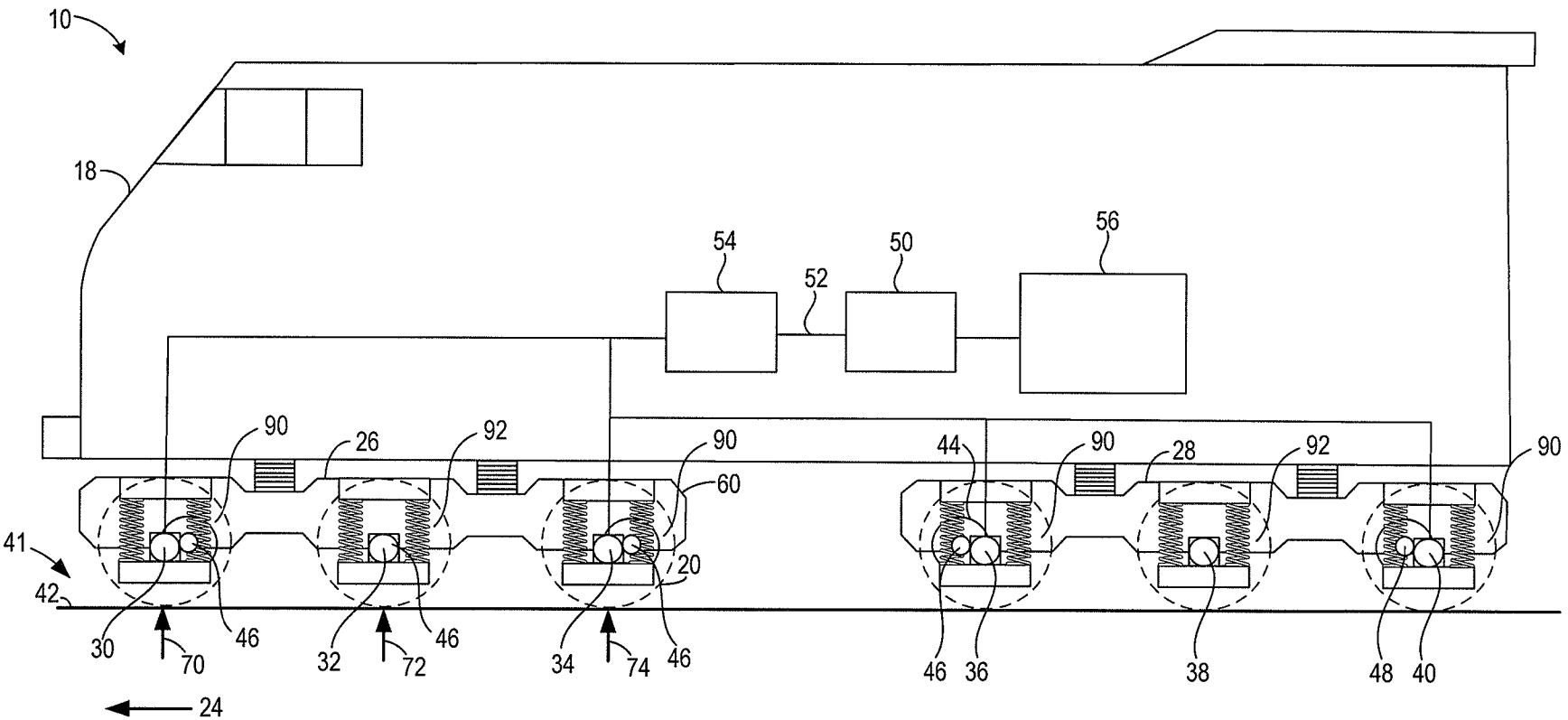

Although FIG. 1 illustrates a locomotive 18, the embodiment of a system 10, and all embodiments discussed herein, may be utilized with other vehicles, including wheeled vehicles, rail vehicles, track vehicles, and locomotives. With reference to FIG. 1, the system 10 is provided for selectively and/or dynamically affecting a normal force 70, 72, 74 applied through one or more of a plurality of locomotive axles 30, 32, 34, 36, 38, 40. The locomotive 18 illustrated in FIG. 1 is configured to travel along a track 41, and includes a plurality of locomotive wheels 20 which are each received by a respective axle 30, 32, 34, 36, 38, 40. Track 41 includes a pair of rails 42. The plurality of wheels 20 received by each axle 30, 32, 34, 36, 38, 40 move along a respective rail 42 of track 41 in a travel direction 24.

As illustrated in the example embodiment of FIG. 1, the locomotive 18 includes a pair of rotatable trucks 26, 28 which are configured to receive a respective plurality of axles 30, 32, 34, and 36, 38, 40. Trucks 26, 28 may include truck frame element 60 configured to provide compliant engagement with carriers (not shown), via a suspension (not shown). The pair of trucks 26, 28 are configured to be rotated, where one or both of the trucks 26, 28 may be rotated 180 degrees from a forward direction, to a rear direction.

Each truck 26, 28 may include a pair of spaced apart powered axles 30, 34, 36, 40 and a non-powered axle 32, 38 positioned between the pair of spaced apart powered axles. The powered axles 30, 34, 36, 40 are each respectively coupled to a traction motor 44 and a gear 46. Although FIG. 1 illustrates a pair of spaced apart powered axles and a non-powered axle positioned there-between within each truck, the trucks 26, 28 may include any number of powered axles and at least one non-powered axle, within any positional arrangement.

Each of the powered axles 30, 34, 36, and 40 each include a suspension 90, and each of the non-powered axles 32 and 38 include a suspension 92. The suspensions may include various elastic and/or damping members, such as compression springs, leaf springs, coil springs, etc. Additional details of the suspensions 90 and 92 are described in more detail herein with regard to FIGS. 2-5. In one example, the non-powered axles 32, 38 may include an actuator configured to dynamically adjust a compression of the non-powered axle suspensions by exerting an internal compression force as described with regard to FIGS. 3-5. For example, the actuator may be a pneumatic actuator, a hydraulic actuator, an electromechanical actuator, and/or combinations thereof. In this way, weight may be dynamically shifted from the non-powered axle 32 to the powered axles 30, 34 of truck 26. Similar dynamic weight shifting can also be carried out in truck 28 in a similar manner. As such, it is possible to cause an upward force on the non-powered axles 32, 38 and increase the tractive effort of the locomotive 18 via a corresponding downward force on the powered axles 30, 34, 36, 40. In particular, in one example, the weight imparted by the powered axles 30, 34 and 36, 40 on the track increases, while the weight imparted by the non-powered axles 32, 38 on the track decreases.

In one example embodiment, an effective spring rate of the powered axle suspensions 90 may vary depending on the deflection between the powered axle and the truck frame such that a non-linear spring rate response is achieved. In contrast, an effective spring rate of the non-powered axle suspensions 92 may be substantially constant with the deflection between the non-powered axle and the truck frame such that a substantially linear spring rate response is achieved. In this way, as described herein, it may be possible to accommodate dynamic weight shifting operation while also improving high speed performance. In particular, suspension 90 operates with a higher effective spring rate under increased dynamic weight to thereby reduce over-compression of suspensions 90. Likewise, suspension 90 operates with a lower effective spring rate under decreased dynamic weight to thereby reduce truck stresses and force transmitted to a locomotive operator during other operating conditions, such as high speed conditions. As used herein, an effective spring rate of an axle suspension refers to the ratio between the normal force applied to the axle and a displacement of the axle toward the truck. In another example, the effective spring rate curve of suspension 90 is different from that of suspension 92.

Returning to FIG. 1, as depicted, in one example, the locomotive is a diesel-electric vehicle operating a diesel engine 56. However, in alternate embodiments of locomotive 18, alternate engine configurations may be employed, such as a gasoline engine or a biodiesel or natural gas engine, for example. A traction motor 44, mounted on a truck 26, 28 may receive electrical power from alternator 50 via DC bus 52 to provide tractive power to propel the locomotive 18. As described herein, traction motor 44 may be an AC motor. Accordingly, an inverter 54 paired with the traction motor may convert the DC input to an appropriate AC input, such as a three-phase AC input, for subsequent use by the traction motor. In alternate embodiments, traction motor 44 may be a DC motor directly employing the output of the alternator after rectification and transmission along the DC bus. One example locomotive configuration includes one inverter/traction motor pair per wheel axle. As depicted herein, 4 inverter-traction motor pairs are shown for each of the powered axles 30, 34 and 36, 40.

Traction motor 44 may act as a generator providing dynamic braking to brake locomotive 18. In particular, during dynamic braking, the traction motor may provide torque in a direction that is opposite from the rolling direction thereby generating electricity that is dissipated as heat by a grid of resistors (not shown) connected to the electrical bus. In one example, the grid includes stacks of resistive elements connected in series directly to the electrical bus. Air brakes (not shown) making use of compressed air may be used by locomotive 18 as part of a vehicle braking system.

As noted above, to increase the traction of driven axles of the truck (by effecting a weight shift dynamically from at least one axle of the truck to at least another axle of the truck), one embodiment uses pneumatically actuated relative displacement between the un-powered axle (e.g., 32 and/or 38) and the truck frame element 60. The relative displacement of the un-powered axle causes a change (e.g., compression) of the axle suspension 92, thus causing a shift of weight to the powered axles, (and additional compression of the suspension 90) to compensate for the reduced normal force 72 at the un-powered axle. This action generates an increased normal force 70, 74 on the powered axles 30, 34, for example.

However, the additional weight carried by the powered axles 30, 34, 36, 40 may cause various issues during operation of the locomotive 18 that may be addressed.

As a first example, under high traction effort conditions where weight is dynamically shifted to the driven axles (and thus these axles operate with increased compression in the suspension), the suspension may be compressed near a condition of maximum compression. Thus, in the example where the suspensions include springs, the springs may "bottom out" due to depletion of reserve in the suspension where the adjacent spring coils come into contact with one another. Alternatively, the springs or axle may reach a hard stop designed to limit displacement of the axle. Such conditions can increase stresses in the locomotive components and reduce the useful life of the locomotive since the axle can no longer accommodate further compression during dynamic operating conditions, such as due to track irregularities, changes in load, and the like.

While it is possible to address the over-compression of the suspension (e.g., springs), for example, by increasing the spring rate of the springs, increasing the spring rate can cause still further issues with locomotive performance. For example, at high speeds, the locomotive suspension action can degrade if the spring rate of the springs is too high. Again, this can lead to increased stress in the locomotive components, and reduce their useful life. Likewise, higher spring rates can reduce ride quality as they can amplify the forces transmitted to locomotive occupants due to track irregularities and other such phenomena.

Therefore, the locomotive may operate with different modes of suspension operation. In a first mode including at least a first amount of dynamic weight transfer from un-powered to powered axles, the powered axle suspension operates with a first effective spring rate. In a second mode including at least a second amount of dynamic weight transfer from un-powered to powered axles, the second amount less than the first amount (including the case of no additional weight transfer), the powered axle suspension operates with a second effective spring rate, the second rate lower than the first rate. As such, weight is transferred from un-powered to powered axles of the rail vehicle to a greater extent in the first mode than the second mode.

In this way, it is possible to operate with increased suspension stiffness during increased dynamic weight transfer operation to thereby reduce the amount of compression force and displacement required to compress the un-powered axle and increase a reserve in the suspension as well decrease the lift force requirement on the mechanism lifting the powered axle (if present). Further, during decreased dynamic weight transfer operation (which may include both the powered and un-powered axles carrying equal weight), such as at high locomotive traveling speeds, it is possible to operate with decreased stiffness in the powered axle suspension to maintain acceptable ride quality and lower truck frame stresses.

Figure 2A:
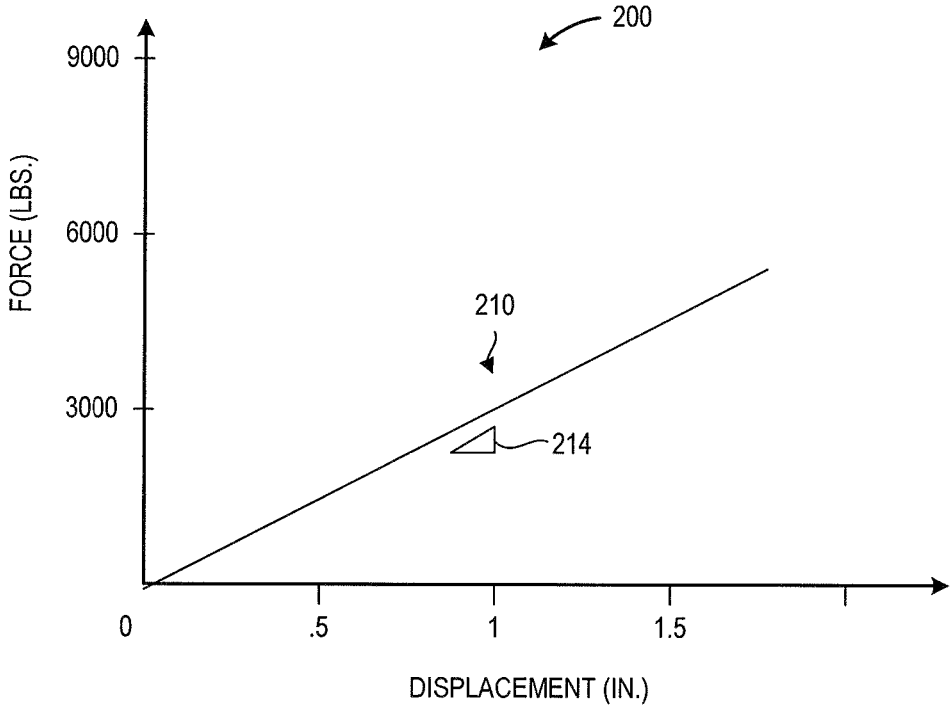

Various approaches can be used to provide the above actions. In one example, as shown in FIG. 2, a powered axle suspension may have a non-linear effective spring rate on the powered axles Referring now specifically to FIG. 2*a*, a graph 200 illustrates an effective suspension spring rate curve with normal force on the vertical axis and displacement on the horizontal axis. A first example effective suspension spring rate 210 is shown that is substantially linear, in that the ratio of the force to displacement (214) is substantially constant over the illustrated range of displacements. As described above herein, suspension 92 may operate with an effective suspension spring rate 210.

Figure 2B:
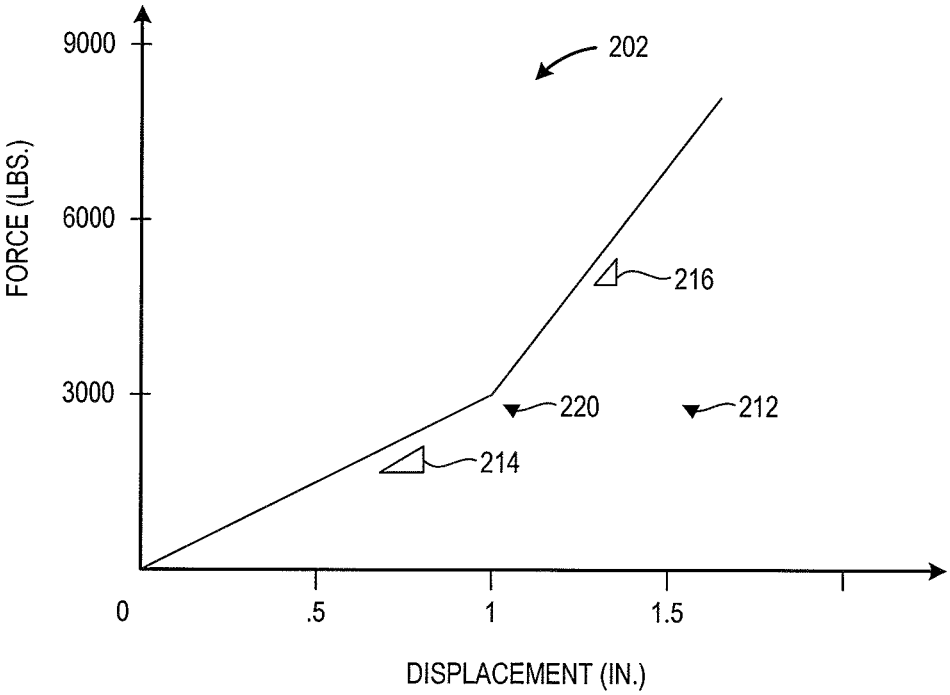

FIG. 2*b* shows a graph 202 that illustrates a second example effective suspension spring rate 212 that is different from effective spring rate 210, where effective spring rate 212 is substantially non-linear. In one example, the ratio of the force to displacement has a first substantially constant rate 214 over a first range of displacements, and a second, different (more stiff), substantially constant rate 216 over a second range of displacements. As described above herein, suspension 90 may operate with an effective suspension spring rate 212. In the example of FIG. 2*b*, the first rate 214 (at smaller displacements which as defined herein refers to lower displacement of an axle vertically toward a truck) is lower (e.g., less stiff) than the second rate 216 (at higher displacements). As described in more detail herein, the transition point 220 (which in this example is approximately 1 inch) may be adjusted to provide different transitions in spring rates among different axles of the locomotive.

While the nonlinear spring rate 212 of FIG. 2 is shown as two linear rates 214, 216, various alternative non-linear spring rates may be used, such as curves, more than two linear segments, etc.

Figure 4A:
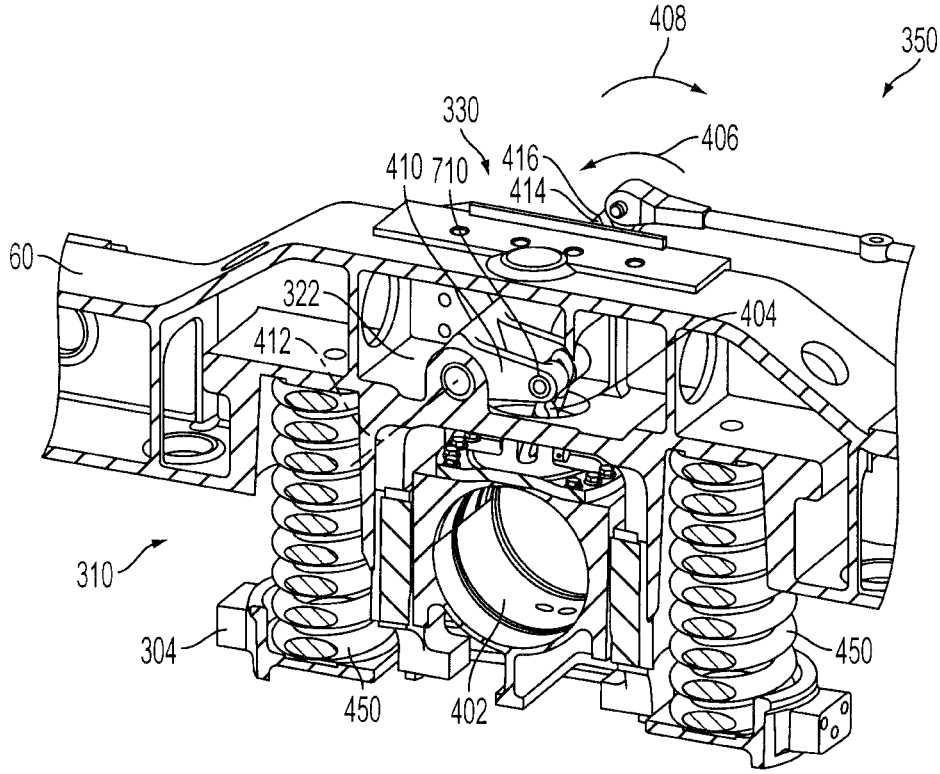
Figure 4B:
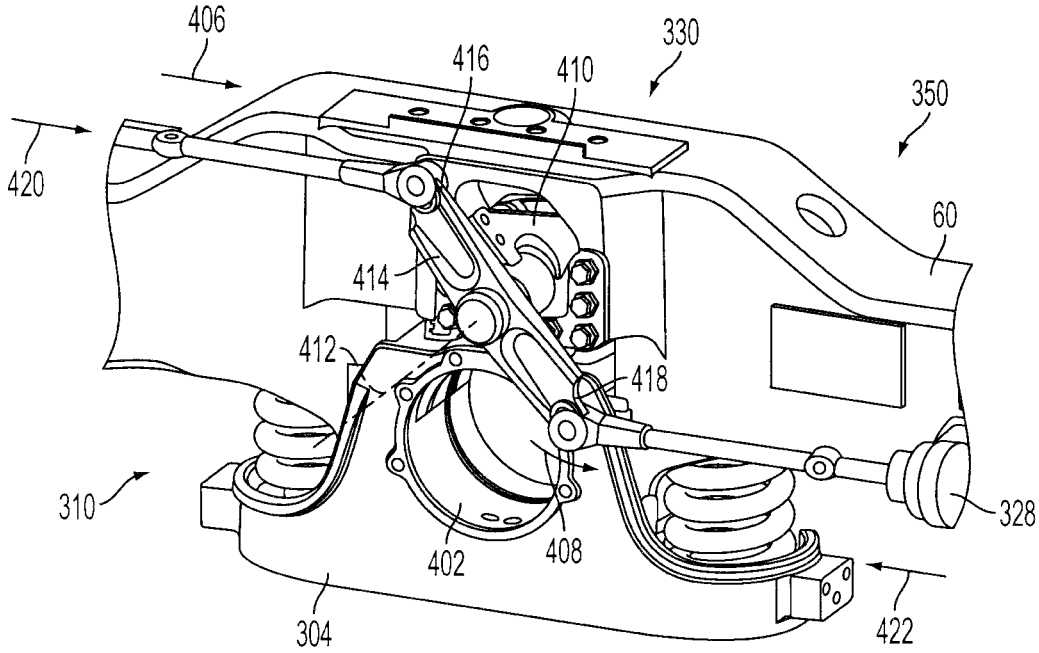
Figure 5:
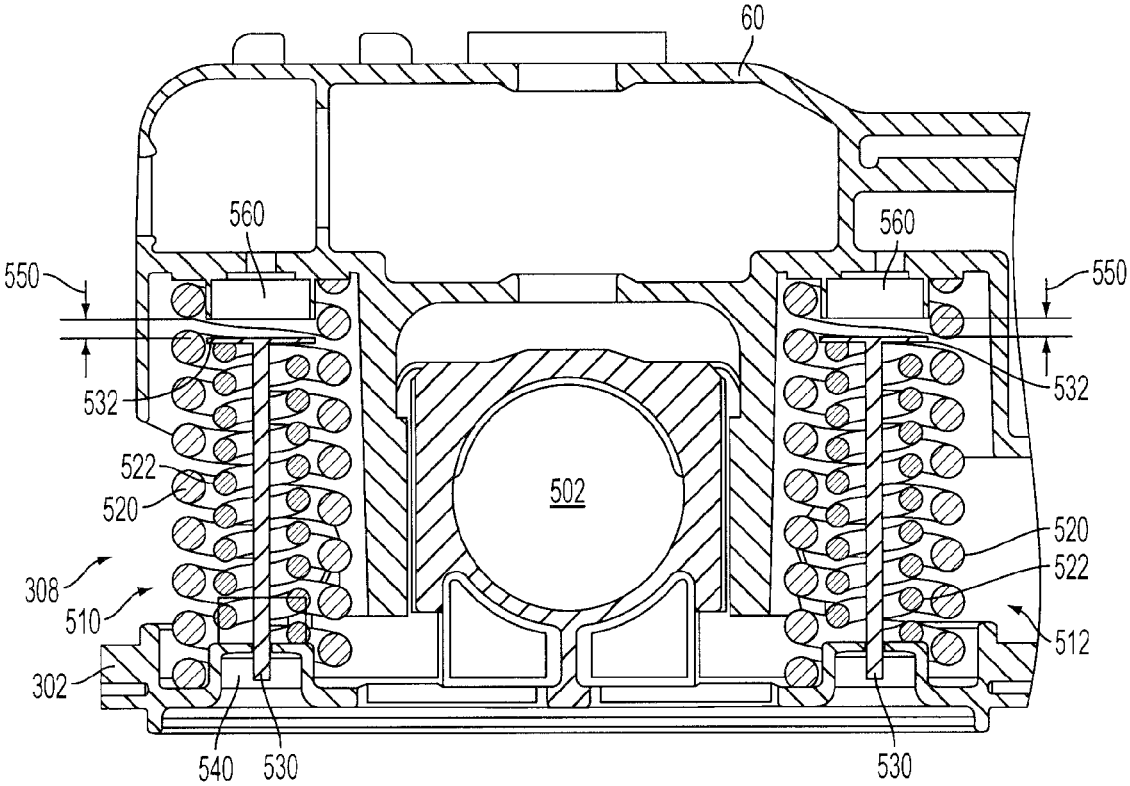
FIG. 5 is a right side section view of a portion of an example truck.

Various approaches may be used to generate a non-linear spring rate, including using a first and second spring in parallel, where the first spring is engaged at less compression than the second spring, for example, such as described in the example of FIGS. 3-5. Further, various other alternative configurations may be used, such as springs with variable pitch, variable wire thickness, variable wire material, etc. FIGS. 8*a*-8*b* show two such examples of different spring configurations to generate a non-linear spring rate, where the springs of FIGS. 8*a* and/or 8*b* may be used in the suspension and/or truck assemblies described herein.

Figure 3A:
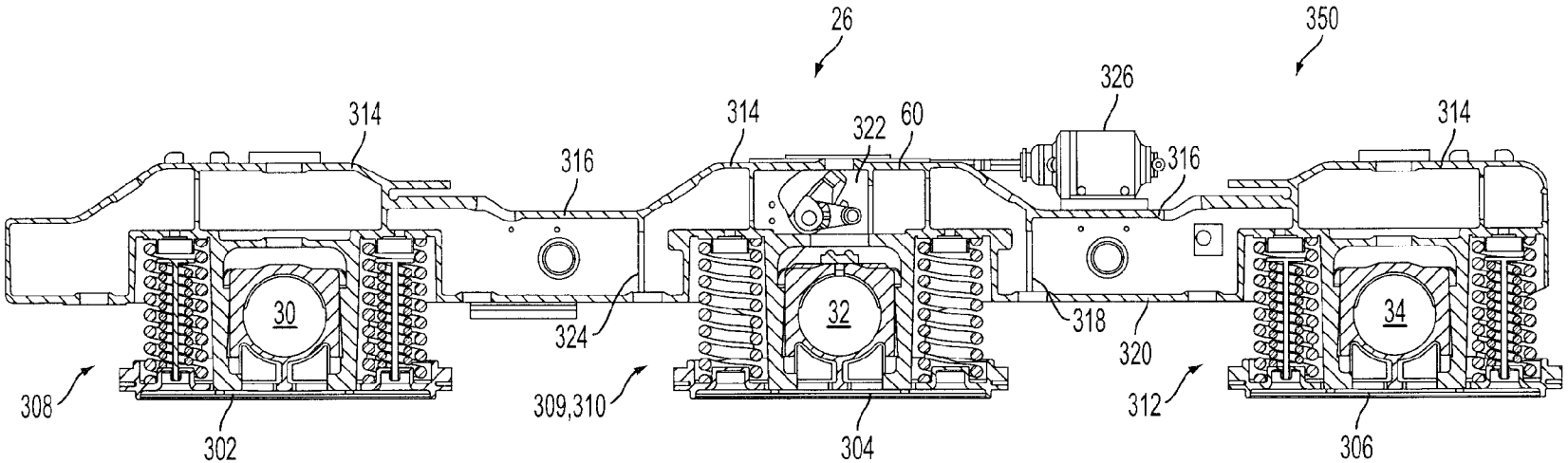
Figure 3B:
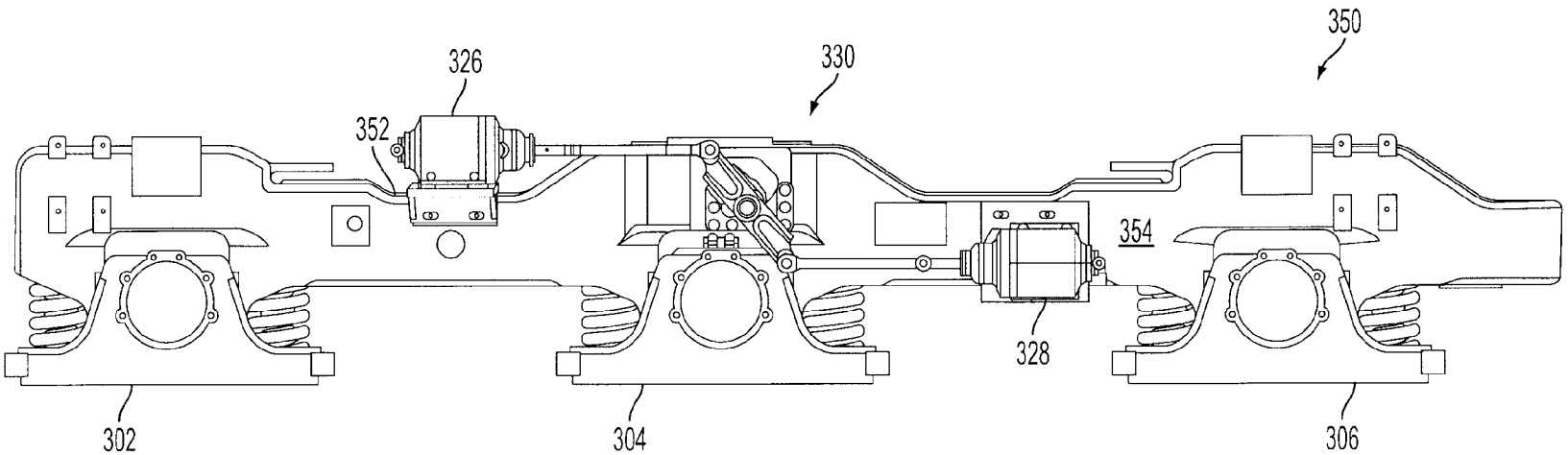

Referring now to FIGS. 3*a* and 3*b*, an example truck configuration 350 is shown with pneumatically controlled compression of the un-powered axle 32. Specifically, FIG. 3*a* illustrates a right side sectional view, and FIG. 3*b* illustrates a left side view of one example truck 26. The truck 26 may include a truck frame element 60 configured for compliant engagement with carriers 302, 304, 306, via a suspension. In the embodiments of FIGS. 3*a*-3*b*, springs systems 308, 310, 312 represent the suspension systems. The truck frame element 60 may comprise generally horizontal portions that may be disposed at various heights. For example, the truck frame element 60 may have relatively higher portions 314 located above the axles 30, 32, 34, and relatively lower portions 316 located between the axles 30, 32, 34. In some examples the truck frame element 60 may be constructed to have a double walled structure that may include webbing 318 to add strength and stiffness to the truck frame element 60. The walls 320, and/or the webbing 318, may provide cavities 322 therebetween, and may include holes 324 therethrough.

Each carrier 304, 304, 306 may be configured to hold the respective axles 30, 32, 34. Specifically, the carriers may be configured as cylindrical bushings, or the like, configured to carry the axle. As mentioned the carriers 302, 304, 306, may be coupled with the truck frame element 60 for compliant movement relative to the truck frame element 60. Each spring system 308, 310, 312 may provide a bias structure 309 configured to support respective portions of the truck frame element 60, and portions of the overlying weight of the locomotive 18. Each bias structure 309 may then bias the truck frame element 60 upward, and away from the carriers 302, 304, 306.

In some examples, portions of the weight supported by each carrier 304, 304, 306, and consequently the upward normal forces 70, 72, 74, on each of the wheels 20 may be selectively, and in some examples, dynamically, redistributed among the carriers 302, 304, 306. In some examples, the weight may be redistributed via a weight transference configured to decrease the weight on the non-powered axle 32, thereby increasing the weight on the powered axle 30, 34 and consequently the tractive effort of the locomotive 18 via a corresponding increase in the normal forces 70, 74 on the powered wheels. Truck 28 may also be similarly constructed such that the weight on the non-powered axle 38, may be decreased, increasing the weight on the powered axles 36, 40 and consequently the tractive effort of the locomotive 18.

Referring again, more specifically to FIGS. 3*a* and 3*b*, various actuating arrangements may be employed to reduce the weight on the non-powered axle 32. For example, a pair of actuators 326, 328 may be coupled with the truck frame element 60. A first actuator 326 may be coupled to, or near, a top surface 352 of one lower portion 316 of the truck frame element 60, and a second actuator 328 may be coupled to, or near, a side surface 354 of another lower portion 316 of the truck frame element 60. The first and second actuators 326, 328 may be pneumatic actuators. In one example, a frame of the actuators 326, 328 is rigidly mounted to the truck frame element 50, such as via bolts through slotted holes in the cylinder frame to allow adjustment to compensate for dimensional tolerance in the truck frame and/or the linkage arrangement components discussed below.

The actuators 326, 328 may be configured to share the actuating load for actuating a linkage arrangement 330, discussed below with regard to FIG. 3*b*. Specifically, the actuators may each generate forces in opposite directions, yet offset from one another, to generate a couple torque that rotates a cam or lever arm to generate lifting force on carrier 304 to displace it relative to, and toward, truck frame element 60. Mechanical advantage may be used by the linkage arrangement to amplify the force from the actuators, and in some examples the mechanical advantage may vary depending on the position of the linkage arrangement. In one particular example, the mechanical advantage increases as the spring system is further compressed. Additional details of the linkage arrangement 330 are described with regard to FIGS. 4*a*-4*b*.

By using at least two pneumatic actuators acting together, each pneumatic cylinder casing for the pneumatic actuators 326, 328 may have a reduced diameter to fit within limited packaging space around the truck and further enable use of off-the-shelf components. Moreover, it reduces the unwanted moment which causes the bending of the shaft (ex 602). In addition, the actuators 326, 328 may be positioned in various locations on the truck 26 to utilize empty space thereon. Other examples may employ motive forces other than, or in addition to, pneumatic actuators, such as hydraulic and/or various direct or indirect actuators, including, but not limited to using one or more servo motors, and the like. Various configurations and numbers of actuators may be employed.

FIG. 4*a* is a sectional perspective view from a first side, and FIG. 4*b* is a perspective view from an opposite second side illustrating an example middle carrier 304, and middle spring system 310, of the locomotive truck assembly 350 shown in FIGS. 3*a* and 3*b*. The carrier 304 may be configured to receive a non-powered axle in hole 402. The locomotive truck assembly 350 may include a truck frame element 60, and a carrier 304 coupled with the truck frame element 60. Spring system 310 may be configured to bias the carrier 304 away from the truck frame element 60.

An actuatable linkage arrangement 330 is shown having a compliant linkage 404 that may be coupled with the carrier 304 to translate rotation of the lever arm 414 by the pneumatic actuator-generated couple into vertical motion of the carrier 304 relative to the truck frame element 60. The compliant linkage 404 may include a chain, a cable, a strap, or the like. A chain is illustrated in the figures. As used herein the compliant linkage 404 operates to pull the carrier 304 against the spring system 310 when the linkage arrangement 330 moves in a first direction 406 (e.g., when pulling carrier 304 toward truck frame element 60). However, the compliant linkage 404 is substantially unable to push against the carrier 304 when the linkage arrangement 330 moves in a second direction 408, opposite the first direction 406. As used herein, compliant linkages substantially unable to push include linkages such as linked chains, as noted above, in which the linkage is able to operate in tension to support a load at least an order of magnitude, and often two or more orders of magnitude, greater than that in compression. In the example of a linked chain, the links of the chain become unengaged in the second direction, and thus are virtually unable to push with any force sufficient to affect the suspension of the locomotive. In one particular, example, the chain can pull as controlled by the actuators and thus is not substantially impacted by the truck hitting a discontinuity in a track, as this will build slack in the chain. Depending on application specific parameters and requirements, other compliant linkages may also be used, such as ropes, cables, slotted rigid members, or others, if desired.

By enabling the compliant linkage to pull the carrier against the bias in the first direction, it is possible to selectively control increased compression of the carrier toward the truck frame element to effect a dynamic re-distribution of the load to other axles of the truck assembly. For example, as the suspension operates to support the locomotive, by increasing and/or decreasing tension in the compliant linkage via the pneumatic actuators, it is possible to dynamically adjust an amount of transfer of supported load from the un-powered axle 32 to the powered axles 30, 34. However, because the compliant linkage is substantially unable to push against the carrier in the second direction, disturbance forces caused by operation of the locomotive along the rails (e.g., due to track irregularities, locomotive dynamics, etc.), a tendency for the compliant linkage to counteract natural suspension action of the spring system 310 during travel is reduced. For example, even when the compliant linkage is in tension to effect dynamic weight transfer from un-powered to powered axles of the locomotive truck, the carrier is still able to be further compressed by external forces (such as due to track irregularities) so that appropriate suspension action is maintained, without requiring the external forces to overcome the actuation force of the pneumatic actuators. In this way, stresses on the frame element may be reduced while a more complaint suspension is maintained. Further, additional components may be includes, such as an accumulator coupled in the pneumatic system that can take advantage of compressibility of the gases to reduce pushing against the carrier under the influence of dynamic forces.

The linkage arrangement 330 may include a crank 410 being pivotable about a fixed pivot axis 412. The crank 410 may have a distal end (see FIG. 7) coupled with the compliant linkage 404. A pivoting of the crank 410 may be configured to move an end of the compliant linkage 404 coupled to the crank distal end in the first direction and the second direction.

The linkage arrangement 330 may also include a lever arm 414 coupled with the crank 410, and configured to effect the pivoting of the crank 410. The lever arm 414 may be configured in various ways, for example as a T-bar. The lever arm 414 may be substantially balanced about the pivot axis 412, and may be respectively coupled at opposite ends 416, 418 to the two actuators 326 (FIG. 3*b*), 328. The two actuators 326 (FIG. 3*b*), 328 may be configured to exert forces from respectively opposite directions 420, 422 to exert a couple on the lever arm 414. The couple may be substantially centered about the pivot axis 412 to pivot the lever arm 414 and the crank 410 about the pivot axis 412, thereby reducing the stresses on the lever arm and crank. In one example, the crank may be suitably centered to take compensate for lateral movement of the axle on a curved track. An additional bearing or bearings may be fitted to the crank to reduce loss of force and friction about the pivot. Portions of the linkage arrangement 330 may be configured to fit within one or more cavities 322 within the truck frame element 60. For example, as illustrated, the crank 410 may fit with a cavity 322. In this way the linkage arrangement may be made compact.

The spring system 310 may include one or more springs 450 configured to couple the axle to the truck frame element 60. While FIGS. 4*a*-4*b* show two springs biasing each carrier away from the truck frame element 60, more or less springs may be used. Continuing with FIGS. 4*a*-4*b*, a top end of each of the springs 450 may be attached to the truck frame element 60, and a bottom end of each spring to a carrier 304. In another example, the springs may not be attached to either or both of the truck frame element 60 or the carrier 304, and may instead be disposed in a guiding slot or the like.

Referring now to FIG. 5, it illustrates a side view illustrating an example carrier 302, and spring system 308, of the locomotive truck assembly 350 shown in FIGS. 3*a* and 3*b*. The carrier 302 may be configured to receive a powered axle in hole 502. Spring system 308 may be configured to bias the carrier 302 away from the truck frame element 60.

It should be appreciated that the spring system 308 for powered axle 30 illustrated in FIG. 5 is substantially similar to the spring system of each powered axle 34, 36, and 40, such as in the example where the locomotive may operate in both forward and reverse directions. However, in an alternative example, a front truck, such as truck 26 (FIGS. 3*a*-3*b*) when travelling in direction 24, may require a greater lift force to compress the middle carrier 304 (FIGS. 3*a*-3*b*) than on a rear truck due to the natural weight transfer within the truck or the locomotive. As such, the spring system 308 may be used only for axles 30 and 34, but not on axles 36 and 40 (FIGS. 3*a*-3*b*).

Continuing with FIG. 5, it shows an example suspension having an effective spring rate that is non-linear with the displacement of the carrier 302 toward the truck frame element 60. In the illustration of FIG. 5, the spring system 308 is shown in an un-loaded, or free, state in that the spring system 308 is not supporting dynamic weight shifted from another axle.

In this example configuration, spring system 308 includes a first spring assembly 510 and a second spring assembly 512. Each spring assembly includes a first, exterior, spring 520 and a second, interior spring, 522. In the example of FIG. 5, the interior and exterior springs are coiled in opposite directions with respect to one another.

The interior spring 522 is pre-compressed and aligned by spring seat bar 530, which is threaded into base element 540 of carrier 302. In one example, the threaded shaft of the spring seat bar 530 allows for height adjustment and adjustment of the pre-compression of spring 522. This enables variation of the non-linear spring rate of the spring assembly 510 to accommodate different locomotive configurations, for example. In an alternative example, a nut on the end (e.g., top) of the spring seat bar 530 may be used to enable adjustment of the engagement deflection of the spring 522.

FIG. 5 also illustrates a gap 550 between the head 532 of the spring seat bar 530 that retains the interior spring 522 in its pre-compressed state and further provides a secure mating surface with the engagement cylinder 560 of the truck frame element 60. In one example, the head 532 may be shaped as a disk.

In the example where a truck includes three axles, such as shown in FIG. 3*a*, the gap in the spring system 308 of axle 30 may be different than that of the gap in spring system 312 of axle 34. For example, the gap in the system of axle 30 may be smaller than the gap of the system of axle 34 so as to compensate for the natural weight transfer of the truck during tractive effort, in that more load may be transferred to axle 30 than to axle 34 in en effort to equalize axle loads among axles 30 and 34 during dynamic weight shifting operation.

Continuing with FIG. 5, in one example, the spring assembly 510 generates the non-linear spring action illustrated in FIG. 2 in that during the initial compression (e.g., displacement of the carrier 302 toward the truck frame element 60) from the free state of FIG. 5, only the exterior spring 520 is compressed. However, once the engagement cylinder 560 contacts the spring seat bar head 532, both the interior spring 522 and exterior spring 520 are compressed, thereby increasing the effective spring rate of the spring assembly 510 as the carrier 302 continues to be compressed toward the truck frame element 60. As such, during operation where only the exterior spring 520 supports the weight of the locomotive (e.g., a substantially low, or no, amount of dynamic weight shifting away from an un-powered axle to a powered axle), the interior spring 522 is not engaged by the engagement cylinder 560 and thus the interior spring 522 does not support the locomotive or couple the locomotive to the rail of the track. However, during operation with both springs 520 and 522 supporting the weight of the locomotive (e.g., a substantially high amount of dynamic weight shifting away from an un-powered axle to a powered axle), the interior spring 522 is engaged by the engagement cylinder 560 and thus the interior and exterior springs 520 and 522 support the locomotive and couple the locomotive to the rail of the track.

While FIG. 5 shows a first and second spring in parallel with one another forming a spring assembly, the springs may alternatively be positioned in series. Further, while different engagement positions are used to generate the non-linear spring action, various alternative approaches may be used as noted herein, such as a single spring with variable wire thickness, variable materials along height of the spring, variable coil pitch, etc.

Figure 6:
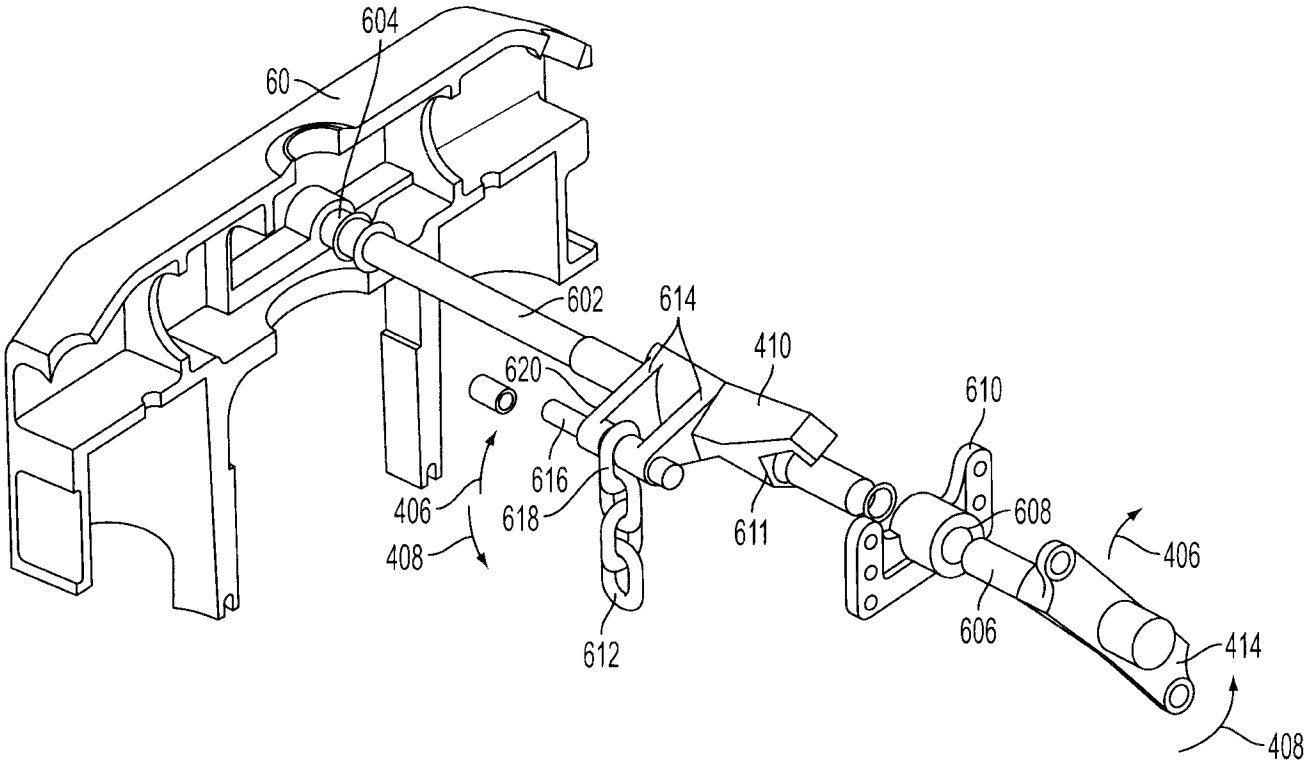
FIG. 6 is an exploded view illustrating components of an example linkage arrangement.

FIG. 6 is an exploded view illustrating components of the linkage arrangement 330 (FIG. 3*a*). A shaft 602 may be supported by a first side of the truck frame element 60. The shaft 602 may, for example, pass through, or fit into, a hole, or a socket 604 in the truck frame element 60. Further, the shaft may be press fit, slide fit, or threaded to the truck frame. In some examples the shaft 602 may be configured to rotate, while in other examples the shaft may be stationary and other components described herein such as the crank 410 and the lever arm 414 may be configured to pivot relative to the shaft 602. In some examples the shaft 602, and other components mounted on the shaft, may pivot relative to one another. In some examples the crank 410 may be coupled with the lever arm 414 via the shaft 602.

In some examples, the shaft 602 may pass through a hole in the crank 410, and may be supported by a bearing 606. The bearing 606 may be supported within a hole 608 in a support plate 610. The support plate 610 may be configured to be attached to a second side of the truck frame element 60. In this way, the shaft 602 may be supported at opposite sides of the truck frame element 60. The support plate 610 may or may not have bearings and may or may not be retained such that rotation is prevented. Thrust bearings may be provided to reduce friction in the lateral direction while the axle translates in the lateral direction while negotiating a curve.

The crank 410 may have a proximal end 611 coupled to the truck frame element 60, and may be configured to pivot about the proximal end 611 in a first direction 406, and in a second direction 408. The crank 410 may also have a distal end 620. A chain 612 may be configured to couple the distal end 620 of the crank 410 to the axle 32, and may be configured to pull on the axle 32 (FIG. 3*a*) against the spring system 310 (FIG. 3*a*) when the crank 410 is moved in the first direction 406. The pull on the axle 32 may be configured to cause a normal force 72 (FIG. 1) on the wheel 82 from the underlying surface to decrease. The bias 309 (FIG. 3*a*) may be configured to cause the normal force 72 to increase.

The crank 410 may have arms 614 configured to receive a pin 616. The pin 616 may pass through a top link 618 on the chain 612 to couple the chain 612 to the distal end 620 of the crank 410. Further, the pin 616 may and the chain may be retained to an arm of the crank 410, such as arm 614. In one example, the lever and crank are sized, positioned, and shaped to increase mechanical advantage of the actuators in displacing the carrier toward the truck frame element, as shown herein. In one particular example as shown, the mechanical advantage is variable as the crank rotates.

Figure 7:
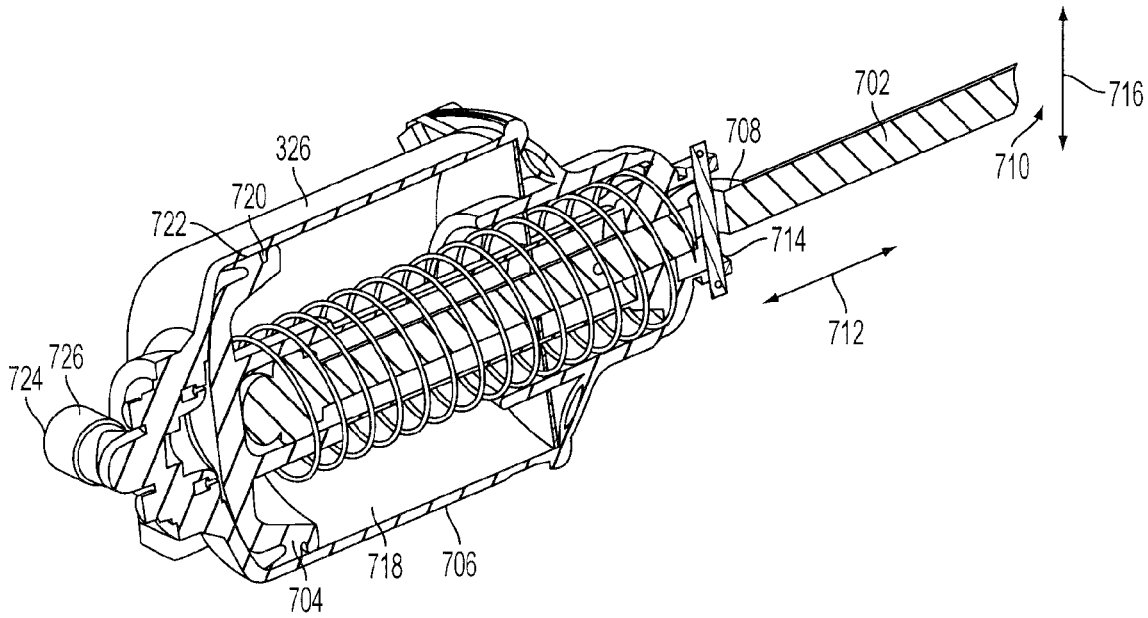
FIG. 7 is a perspective sectional view of an example actuator.

FIG. 7 is perspective sectional view of an example actuator 326 (FIG. 3*a*). As illustrated each of the two actuators 326, 328 shown in earlier described figures may includes a ram 702, a piston 704, and a cylinder 706. The ram 702 may have a proximal end 708 coupled with the piston 704. The piston may be in sliding engagement with the cylinder 706. Each ram 702 may also have a distal end 710 respectively coupled with each of the opposites ends 416, 418 of the lever arm 414 (FIG. 4*b*). A pressurized fluid may provide a motive force to move the piston 704 relative to the cylinder 706 and to move the ram 702 in a direction 712 being substantially longitudinal with the truck frame element 60 (FIG. 4*b*). The ram 702 may be loosely restrained within an opening 714 of the cylinder 706 to allow the distal end 710 of the ram 702 to move in a direction being substantially transverse 716 to truck frame element 60 by an amount at least sufficient to follow a vertical movement of one of the opposites ends 416, 418 of the lever arm 414 (FIG. 4*b*). As such, the ram 702 may be angularly compliant with respect to the cylinder 706 of the actuator. In one example, the ram 702 moves coaxially along the longitudinal direction. The ram may also rotate around its axis to fit the T-bar in different orientations. Additional supports may be added to the rod of the cylinder to reduce the load on the ram and push rod at maximum compliance or over the entire range of compliance In some examples, the cylinder 706 may have a smooth inner surface. The actuators 326 may also include an O-ring 720 disposed at a junction 722 between the piston 704 and the inner surface 718 of the cylinder 706. In one example, the ram may be constructed with low friction seals to increase the change in force with a change in pressure over an entire stroke. A return spring also may be incorporated to pull the ram to its rest position upon deactivation of compressed air. Further still, joints allowing three degree of freedom, such as a ball and socket joint, may be used to couple the mechanism to 304 as it can travel in lateral and longitudinal direction.

The cylinder 706 may include a large orifice valve 724 for quick release of the pressurized fluid upon occurrence of, for example, a brake application and/or a wheel slide occurrence. The cylinder 706 may also include a controlled relief valve 726 configured for fine control of the ram 702, and consequently the compliant linkage 404, i.e., in some examples, the chain 612 (FIG. 6).

FIGS. 8*a*-8*b* show example spring systems. Specifically, FIG. 8*a* shows an example compression spring 802 that may be used to provide an effective non-linear spring rate. Spring 802 has a variable coil pitch, in which a first portion of the spring has a first pitch 810, and a second portion of the spring has a second pitch 812, the second pitch smaller than the first pitch. Likewise, FIG. 8*b* shows another example having a first compression spring 804 and second compression spring 806 in series. In this example, compression spring 804 and second compression spring 806 each have different spring rates, one greater than the other. In this example, the different spring rates are generated by different coil pitches between springs 804 and 806. Specifically, spring 804 has a first pitch 820 and spring 806 has a second, smaller, pitch 822.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A vehicle truck assembly, comprising:

a carrier coupled with a truck frame element, the carrier carrying an axle;

a bias structure configured to bias the carrier away from the truck frame element; and an actuatable linkage arrangement including a vertically positioned compliant linkage coupled with the carrier, the compliant linkage configured to pull the carrier vertically against the bias in a first direction toward the truck frame element, and the compliant linkage being unable to push against the carrier in a second direction that is about opposite the first direction.

2. The truck assembly of claim 1, wherein the linkage arrangement includes a crank being pivotable about a pivot axis fixed relative to the truck frame element, the crank having a linkage end coupled with the compliant linkage, a pivoting of the crank configured to move the compliant linkage in the first direction and in the second direction.

3. A vehicle truck assembly, comprising:

a carrier coupled with a truck frame element, the carrier carrying an axle;

a bias structure configured to bias the carrier away from the truck frame element;

an actuatable linkage arrangement including a compliant linkage coupled with the carrier, the compliant linkage configured to pull the carrier against the bias in a first direction toward the truck frame element, and the compliant linkage being unable to push against the carrier in a second direction that is about opposite the first direction; and two actuators and a lever arm coupled with the crank and configured to effect the pivoting of the crank, wherein the lever arm is configured to pivot about the pivot axis, the lever arm being coupled at opposite ends thereof to the two actuators, the two actuators configured to exert forces from respectively opposite directions to exert a couple on the lever arm, the couple substantially centered about the pivot axis to pivot the lever arm and the crank about the pivot axis, the lever and crank sized and positioned to increase mechanical advantage of the actuators in displacing the carrier in the first direction;

wherein the linkage arrangement includes a crank being pivotable about a pivot axis fixed relative to the truck frame element, the crank having a linkage end coupled with the compliant linkage, a pivoting of the crank configured to move the compliant linkage in the first direction and in the second direction.

4. The truck assembly of claim 3, wherein each of the two actuators have a longitudinal axis, and wherein each of the two actuators include a pneumatically actuated ram configured to move coaxial with, and transverse to, the longitudinal axis.

5. The truck assembly of claim 3, wherein each of the two actuators includes a ram, a piston and a cylinder, the ram having a proximal end coupled with the piston, the piston being in sliding engagement with the cylinder, and each ram having a distal end respectively coupled with each of the opposites ends of the lever arm, a pressurized fluid providing a motive force to move the piston relative the cylinder and to move the ram in a direction being about longitudinal with the truck frame element, the ram being loosely restrained within an opening of the cylinder to allow the distal end of the ram to move in a direction being substantially transverse to the truck frame element by an amount at least sufficient to follow a vertical movement of one of the opposites ends of the lever arm.

6. The truck assembly of claim 5, wherein the cylinder includes a smooth inner surface, and further comprising an 0-ring disposed at a junction between the piston and the inner surface of the cylinder.

7. The truck assembly of claim 5, wherein the cylinder includes a first orifice valve for quick release of the pressurized fluid upon occurrence of a brake application or a wheel slide occurrence.

8. The truck assembly of claim 5, wherein the cylinder includes a controlled relief valve configured for fine control of the ram, and consequently the compliant linkage.

9. The truck assembly of claim 5 wherein the compliant linkage includes a chain.

10. A vehicle, comprising:

a truck arrangement having a driven axle and an un-driven axle, the un-driven axle exerting a force to support the truck arrangement, the force being selectively reducible by pulling a compliant linkage against a bias, and the force being selectively increasable by the bias upon releasing the compliant linkage, wherein the compliant linkage is a chain.

11. The vehicle of claim 10, wherein the reduction of the force on the un-driven axle causes a normal force, and a corresponding tractive force, to increase on the driven axle.

12. A vehicle, comprising:

a truck arrangement having a driven axle and an un-driven axle, the un-driven axle exerting a force to support the truck arrangement, the force being selectively reducible by pulling a compliant linkage against a bias, and the force being selectively increasable by the bias upon releasing the compliant linkage;

wherein the reduction of the force on the un-driven axle causes a normal force, and a corresponding tractive force, to increase on a driven axle;

wherein the compliant linkage is coupled with a crank, the crank is coupled with a lever arm via a shaft, a rotation of the lever arm in a first direction configured to cause the crank to pivot in the first direction and to pull the compliant linkage, and a rotation of the lever arm in a second direction configured to cause the crank to pivot in the second direction and to release the compliant linkage.

13. The vehicle of claim 12, further comprising two spaced apart actuators coupled with respective opposite ends of the lever arm, wherein the two spaced apart actuators are configured to exert substantially equal moments on the lever arm centered about a pivot axis, the pivot axis being substantially co-linear with a center axis of the pivot axis.

14. The vehicle of claim 13, wherein each of the two spaced apart actuators includes a pneumatically actuated cylinder configured to move a ram in a longitudinal direction and in a transverse direction.

15. The vehicle of claim 14, wherein the cylinder includes a first orifice valve for quick release of a pressurized fluid upon occurrence of a brake application, and wherein the cylinder includes a controlled relief valve configured for fine control of the ram and the compliant linkage.

16. A truck assembly, comprising:

a spring system including a coiled spring coupling a carrier to a truck frame element, the spring system configured to transmit at least some weight from the truck frame element to an axle, the spring system biasing the axle away from the truck frame element;

a first pneumatic actuator coupled to the truck frame element;

a second pneumatic actuator coupled to the truck frame element;

a linkage arrangement coupling the first and second pneumatic actuators to the carrier, the linkage arrangement including a chain, the chain including at least one linkage, wherein actuation of the first and second pneumatic actuators generates tension in the chain, the tension pulling the carrier toward the truck frame element and compressing the spring system.

17. The truck assembly of claim 16 wherein the linkage arrangement includes a T-bar and a crank, the crank being coupled to the T-bar, the T-bar being coupled to the first and second pneumatic actuators, the chain being coupled to and between the crank and the carrier, the first and second pneumatic actuators being positioned on opposite sides of the crank, and wherein the first and second pneumatic actuators are further positioned to generate a couple on the T-bar to rotate the crank and pull the chain.

18. The truck assembly of claim 17 wherein the first and second pneumatic actuators are vertically offset from one another.

19. A locomotive for use on rails comprising the truck assembly of claim 16.

* * * * *

UNITED STATES PATENT AND TRADEMARK OFFICE

CERTIFICATE OF CORRECTION

PATENT NO. : 8,443,735 B2
APPLICATION NO. : 12/353625
DATED : May 21, 2013
INVENTOR(S) : Kumar et al.

It is certified that error appears in the above-identified patent and that said Letters Patent is hereby corrected as shown below:

In the Specifications:

In Column 6, Line 22, delete “axles” and insert -- axles. --, therefor.

In Column 7, Lines 51-52, delete “truck frame element 50,” and insert -- truck frame element 60, --, therefor.

In Column 9, Lines 11-12, delete “complaint suspension” and insert -- compliant suspension --, therefor.

In Column 10, Line 40, delete “en effort” and insert -- an effort --, therefor.

In Column 12, Line 11, delete “compliance” and insert -- compliance. --, therefor.

In the Claims:

In Column 13, Line 59, in Claim 6, delete “0-ring” and insert -- O-ring --, therefor.

Signed and Sealed this
Third Day of September, 2013

Teresa Stanek Rea
*Acting Director of the United States Patent and Trademark Office*